United States Patent [19]

Hayes

[11] Patent Number: 4,536,900

[45] Date of Patent: Aug. 27, 1985

[54] WATER CONSERVING FLUSH VALVE FOR TOILETS

[76] Inventor: Garrett P. Hayes, 72 Burlington Ave., Leonardo, N.J. 07737

[21] Appl. No.: 612,619

[22] Filed: May 21, 1984

[51] Int. Cl.[3] ..... E03D 5/094

[52] U.S. Cl. ..... 4/324

[58] Field of Search ..... 4/324, 325, 378, 393, 4/392, 411, 412, 413, 414, 415, 326, 327

[56] References Cited

U.S. PATENT DOCUMENTS

| | | | |
|---|---|---|---|
| 3,795,016 | 3/1974 | Eastman | 4/415 |
| 3,811,134 | 5/1974 | Throckmorton et al. | 4/18 |
| 3,908,203 | 9/1975 | Jackson | 4/415 |
| 4,009,497 | 3/1977 | Moon | 4/415 |
| 4,017,912 | 4/1977 | Young, Sr. | 4/324 |
| 4,020,508 | 5/1977 | Morgan | 4/326 |
| 4,038,708 | 8/1977 | Perrine et al. | 4/415 |
| 4,080,667 | 3/1978 | Walsh et al. | 4/415 |
| 4,080,668 | 3/1978 | Banes | 4/325 |
| 4,135,262 | 1/1979 | Overbey | 4/325 |
| 4,149,283 | 4/1979 | Knudtson | 4/324 |
| 4,175,295 | 11/1979 | Cameron | 4/327 |
| 4,183,107 | 1/1980 | Hare et al. | 4/324 |
| 4,240,167 | 12/1980 | Gilliland | 4/324 |
| 4,250,579 | 2/1981 | Moon | 4/415 |
| 4,364,129 | 12/1982 | Schoager | 4/324 |
| 4,365,365 | 12/1982 | Antunez | 4/392 X |
| 4,388,736 | 6/1983 | Roosa et al. | 4/324 |

*Primary Examiner*—Stephen Marcus
*Assistant Examiner*—Leo J. Peters
*Attorney, Agent, or Firm*—Peter L. Michaelson

[57] ABSTRACT

A water conserving flush valve for use in a toilet tank is described. This flush valve is comprised of a valve, pivoting about an overflow tube contained in the tank, for directing water from the tank in order to produce a flush; means, responsive to rotational movement of a flush handle in a first direction for opening the valve in order to initiate a flush; and means, situated about the overflow tube and responsive to rotational movement of the flush handle in a second direction occurring at any time during the flush for forcing the valve to pivotally rotate to a closed position in order to pre-maturely close the valve, thereby limiting the amount of water consumed during the flush and, in turn, conserving water.

16 Claims, 5 Drawing Figures

WATER CONSERVING FLUSH VALVE FOR TOILETS

BACKGROUND OF THE INVENTION

1. Field of the Invention

The present invention is directed to a water conserving device for use in toilets and, more particularly, to a flush valve which, through operation of a single flush handle, can be prematurely closed after the initiation of a flush.

2. Description of the Prior Art

Water, while plentiful in many areas of the world, is becoming increasingly limited or even scarce in many other areas. Unfortunately, water is often wasted—even where it is available in limited quantities.

One particular area which traditionally consumes more water than necessary and is thus responsible for wasting a significant amount of water is the toilet tank. Commonly used toilet tanks generally hold between three and four gallons of water and consume substantially all this water for each flush. Since the volume of water actually needed for flushing varies with the type and volume of waste, this use of a large, fixed volume for each flush is, over time, extremely wasteful. If, for example, in any community, one to two gallons would be saved per flush per toilet, this in turn would produce significant water savings in a very short period of time.

A variety of different types of water-conserving devices for use in toilets are known. For example, one type comprises one or more flexible wall surfaces or dams (sometimes referred to as "dikes") which are inserted into the toilet tank. These flexible walls are used to isolate a pre-determined quantity of water existing in the tank from the flush valve situated at the outlet of the tank. In effect, these devices form a water column, around the flush valve, which contains significantly less water than the total amount held by the tank. Since only the water existing in the water column is available for flushing, these dams do indeed conserve water. Illustrative examples of such structures are described in U.S. Pat. Nos. 4,250,579 (issued to J. R. Moon on Feb. 17, 1981); 4,080,667 (issued to R. M. Walsh et al on Mar. 28, 1978); 4,009,497 (also issued to J. R. Moon on Mar. 1, 1977); and 3,811,134 (issued to T. M. Throckmorton et al on May 21, 1974). Even though these dam type structures do save water, they can not release the full amount of water stored in the tank when required by the type and volume of waste to be flushed. Thus, these devices often produce incomplete flushes which subsequently require a second or even a third flush to completely expel the waste. Any water saving generated by the first flush is either balanced or out-weighed by the water required by the subsequent flushes.

Another type of water-conserving device involves those which permit both full and partial ("dual-mode") flushing, i.e. permit the release of all or a pre-selected fixed portion of the total water stored in the toilet tank. An illustrative device of this type is disclosed in U.S. Pat. No. 3,795,016 (issued to E. A. Eastman on Mar. 5, 1974). Here, two independent control valves are disposed at different water levels within the tank, and one or both of these valves are opened by downward rotation of a flush handle through a relatively small or an increased arc, respectively. While this device does permit either a full or partial flush, this device possesses various drawbacks. First, installation of this device is relatively complex. Second, and more important, users may often depress the flush handle with enough force to inadvertently initiate a full flush when only a partial flush is necessary—thereby wasting water. Third, by virtue of the relatively large fixed quantity of water consumed during a partial flush, water may still be wasted during such a flush if only liquid wastes need to be removed. Other dual-mode devices which suffer from one or more of these drawbacks are disclosed in U.S. Pat. Nos. 3,908,203 (issued to M. J. Jackson on Sept. 30, 1975); and 4,175,295 (issued to R.L. Cameron on Nov. 27, 1979).

Applicant, in his co-pending U.S. patent application Ser. No. 560,934 filed Dec. 13, 1983, discloses an effective dual-mode flush valve which eliminates many of the problems inherent in prior art dual-mode devices. However, applicant has recently discovered that, as a result of the size of his dual-mode device, this device may, when installed in certain rotational positions in the tank, partially prevent the arm running between the fill valve and its associated float from freely moving throughout its entire vertical range.

A third type of water conserving device involves those which pre-maturely close the flush valve. While this third type holds the most promise for achieving effective water conservation while avoiding the drawbacks inherent in the other types, prior art devices of this type also possess significant drawbacks which limit their widespread acceptance. For example, U.S. Pat. No. 4,038,708 (issued to P. M. Perrine et al on Aug. 2, 1977) discloses a device which is actuated by every flush. Since this device operates even when a full flush is required, ineffective flushing, requiring subsequent flushing and increased water consumption over that required for a single full flush, often results. Thus, this device suffers the same drawbacks as the dam type structures described above. This particular drawback is overcome in the structure disclosed in U.S. Pat. No. 4,135,262 (issued to C. A. Overbey on Jan. 23, 1979) in which a full flush can be obtained by inhibiting the flush valve from closing pre-maturely. Unfortunately, this structure requires the installation of another control, in addition to the flush handle, onto the exterior of the toilet tank. This second control, when depressed, allows the flush valve to close pre-maturely thereby producing a partial flush. Unfortunately, users, generally not accustomed to seeing two flush controls on a toilet tank, would well find use of a second control to be cumbersome and as a result might simply ignore its existence and thus forego conserving water. Moreover, many homeowners might regard the existence of a second control on the exterior of the tank as unaesthetic and/or installation of this structure as being too complex.

Other structures which rely on pre-maturely closing a flush valve are disclosed in U.S. Pat. Nos. 4,364,129 (issued to J. S. Schonger on Dec. 21, 1982); and 4,183,107 (issued to N. S. Hare et al on Jan. 15, 1980). While both these structures conserve water, are simple to install, and operate through the existant single flush handle found on a toilet, these structures do not close the flush valve sufficiently fast after the user releases the handle to terminate the flush. Thus, these structures disadvantageously waste some water although not nearly as much as other prior art devices.

SUMMARY OF THE INVENTION

Accordingly, an object of the present invention is to provide a water conserving flush valve, for use in a toilet, which can release any desired and required amount of water, contained in a toilet tank, from none to a full flush.

A particular object is to provide such a flush valve which is controlled through an existing flush handle mounted on a toilet.

Another particular object is to provide such a flush valve which is easy to operate.

Another particular object is to provide such a flush valve which is simple, inexpensive to produce and easy to install.

Lastly, another particular object is to provide such a flush valve which closes quickly, whenever the user decides to pre-maturely terminate an on-going flush, in order to maximally conserve water.

These and other objects are accomplished in accordance with the present invention by a flush valve comprised of: a valve, pivoting about an overflow tube contained in a toilet tank, for directing water from the tank to produce a flush; means responsive to rotational movement of a flush handle in a first direction for opening the valve in order to initiate a flush; and means, situated about the overflow tube and responsive to rotational movement of the flush handle in a second direction occurring at any time during the flush, for forcing the valve to pivotally rotate to a closed position in order to pre-maturely close the valve, thereby limiting the amount of water consumed during the flush and, in turn, conserving water.

BRIEF DESCRIPTION OF THE DRAWING

The principles of the present invention should be readily apparent to anyone skilled in the art from a consideration of the detailed description and accompanying drawing in which.

To facilitate understanding, identical reference numerals have been assigned to those elements common to the figures.

DETAILED DESCRIPTION

Figure 1:
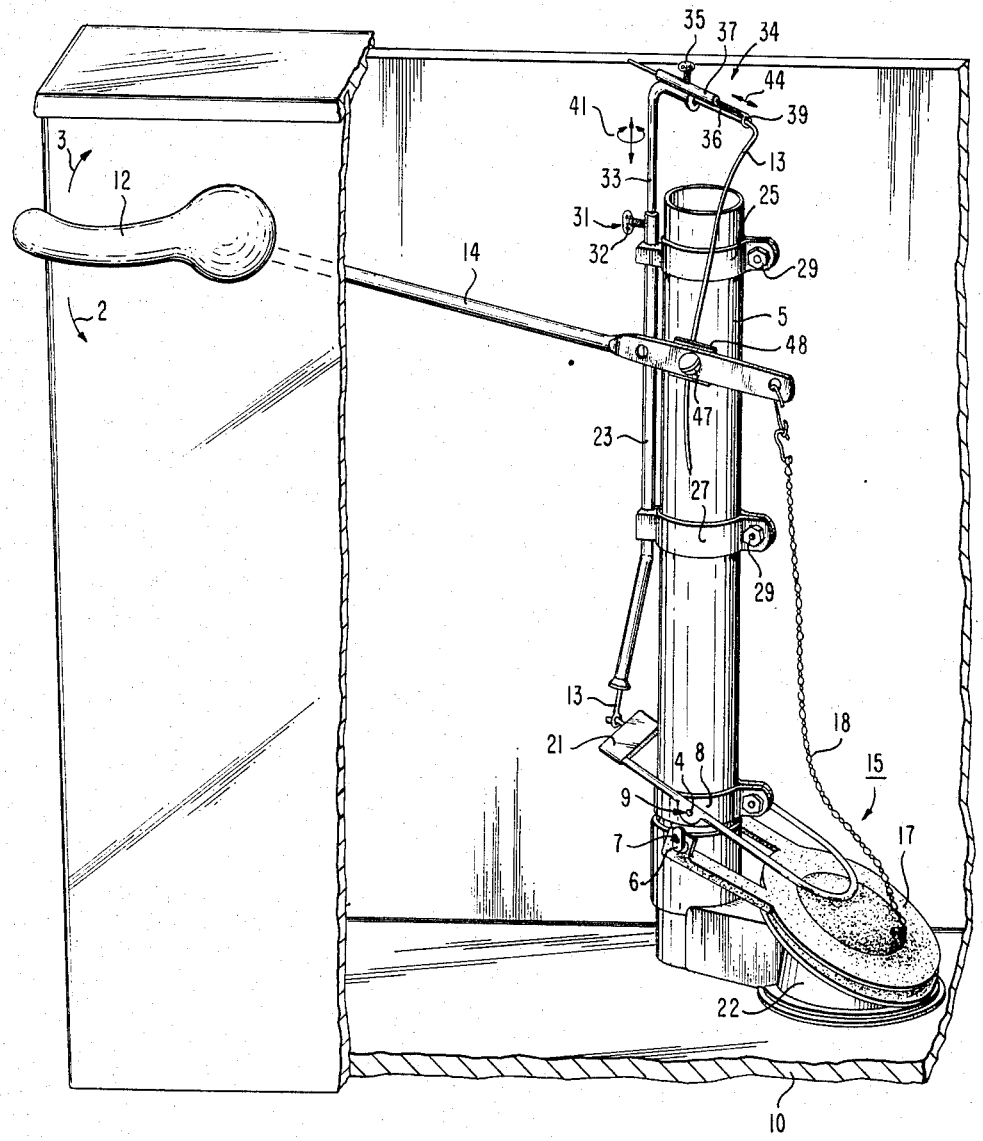
FIG. 1 is a partial cutaway view of toilet tank 10 showing a flush valve embodying the principles of the present invention.

FIG. 1 is a partial cutaway view of toilet tank 10 in which a flush valve embodying the principles of the invention is mounted. Any working toilet tank would also contain an appropriate fill valve, float, and float arm; inasmuch as these latter three devices do not form part of applicant's invention, they have been omitted from all the figures for purposes of clarity.

As shown, tank 10 includes an overflow tube 5, to which a flush valve 15 embodying the principles of the invention is mounted, flush handle 12 and extension 14. Overflow tube 5 prevents the water which is supplied to the toilet by a fill valve (not shown) from exceeding a pre-selected amount and over-flowing the confines of the tank. The overflow tube is of conventional design and well-known in the art.

As explained in detail below flush handle 12 can be rotated in either one of two directions, downward, as shown by arrow 2, to initiate a flush and upward, as shown by arrow 3, to pre-maturely terminate any flush any time after it has been initiated.

Flush valve 15 is mounted to the base of the overflow tube. This flush valve includes a flapper valve, such as flapper valve 17 which is of conventional design well-known in the art, and abutting (forcing) member 19 which along with flapper valve 17 are both connected through cable 13 and chain (or cable) 18, respectively, to extension 14 of flush handle 12. Whenever it is closed, flapper valve 17 seats in base 22 of the overflow tube and, aside from any water entering the top of the overflow tube, effectively prevents any water existing in the tank from entering the toilet bowl (not shown for clarity).

Both the flapper valve and the abutting member rotate about respective pivot points 7 and 9 (as well as similar situated points located on the opposite side of the overflow tube but not visible in the drawing—to simplify the ensuing discussion each subsequent reference to a pivot point is to be taken to include the corresponding oppositely situated point). Whenever the flapper valve is closed, as shown in FIG. 1, and no external force is applied to flush handle 12, the abutting member is appropriately balanced about pivot point 9 such that it and cable 13 exert substantially no force to extension 14 which, in turn, would cause flush handle 12 to rotate. If necessary in practice, appropriate well-known weights (not shown), such as properly sized pieces of lead, may be fixedly mounted to flat surface 21 situated at the rear of abutting member 19 in order to achieve this balanced condition. Pivot point 9 is generally provided by an appropriately sized shaft 4 projecting outward from opposite sides of clamp 8 which is attached to overflow tube 5. In a similar manner, pivot point 7 consists of two right-angle extensions 6, each situated on an opposite side of the lower section of the overflow tube.

Cable 13 is routed to downwardly extend to extension 14 both through conduit 23, which is in turn secured to overflow tube 5 by means of clamps 25 and 27, and through conduit 33. These clamps are tightly secured to the overflow tube through appropriate fasteners, such as nuts and bolts, collectively shown as hardware 29. Telescoping sections 31 and 34 permit cable 13 to be routed clear of the overflow tube, float and float arm and to run downward in essentially and preferably a vertical direction to screw 47 and retaining plate 48 both situated near an end of extension 14.

Telescoping section 31 is comprised of conduit 33 which can be vertically moved within conduit 23. This section, as shown by arrows 41, allows the height and rotational position of cable 13 to be appropriately set. Once this section is appropriately adjusted, set screw 32 is appropriately tightened to effectively lock conduit 33 in place. Telescoping section 34, which provides for lateral positioning of cable 13 as shown by arrow 44, is comprised of rod 36 which moves within section 37. Loop 39, through which cable 13 is routed, is situated at the end of rod 36 and appropriately guides the cable. Set screw 35, when tightened, locks rod 36 in position. By virtue of routing cable 13 through conduits 23 and 33, this cable will move in a substantially opposite direction to that of chain 18 whenever flush handle 12 is rotated in either direction.

Figure 2:
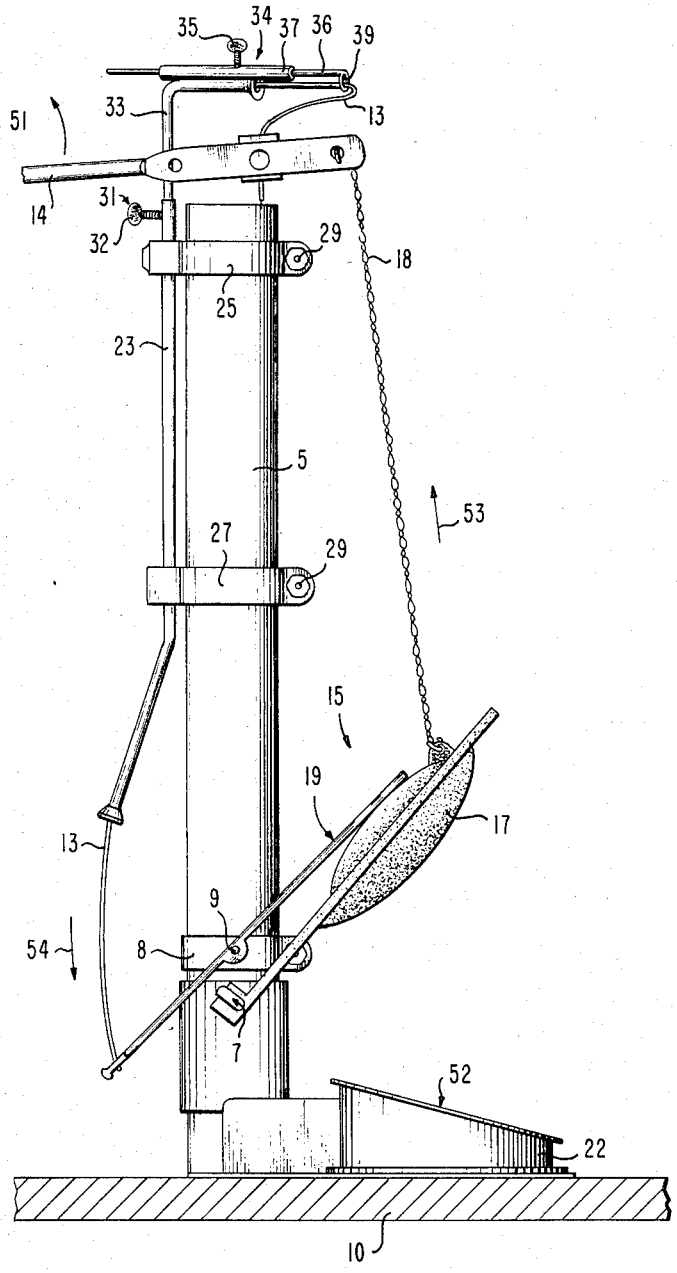
FIG. 2 is a side view, of the flush valve shown in FIG. 1, which shows the position of the valve during initiation of a flush.

To initiate a flush, flush handle 12 is depressed, i.e. rotated in the direction of arrow 2 as shown in FIG. 1, which, in turn, rotates extension 14 in a upward direction, as shown by arrow 51 shown in FIG. 2. This upward rotation pulls chain 18 upward, in the direction of arrow 53, which lifts flapper valve 17 up and off of base 22 of overflow tube 5. As a result, water is directed through hole 52 in base 22 to the toilet bowl. Upward movement of extension 14 and flapper valve 17 causes cable 13, which is connected to an end of the abutting member located farthest from the flapper valve, to extend downward out of the lower end of conduit 23, as shown by arrow 54, and abutting member 19 to both abut against the flapper valve and pivot upward about pivot point 9.

Figure 3:
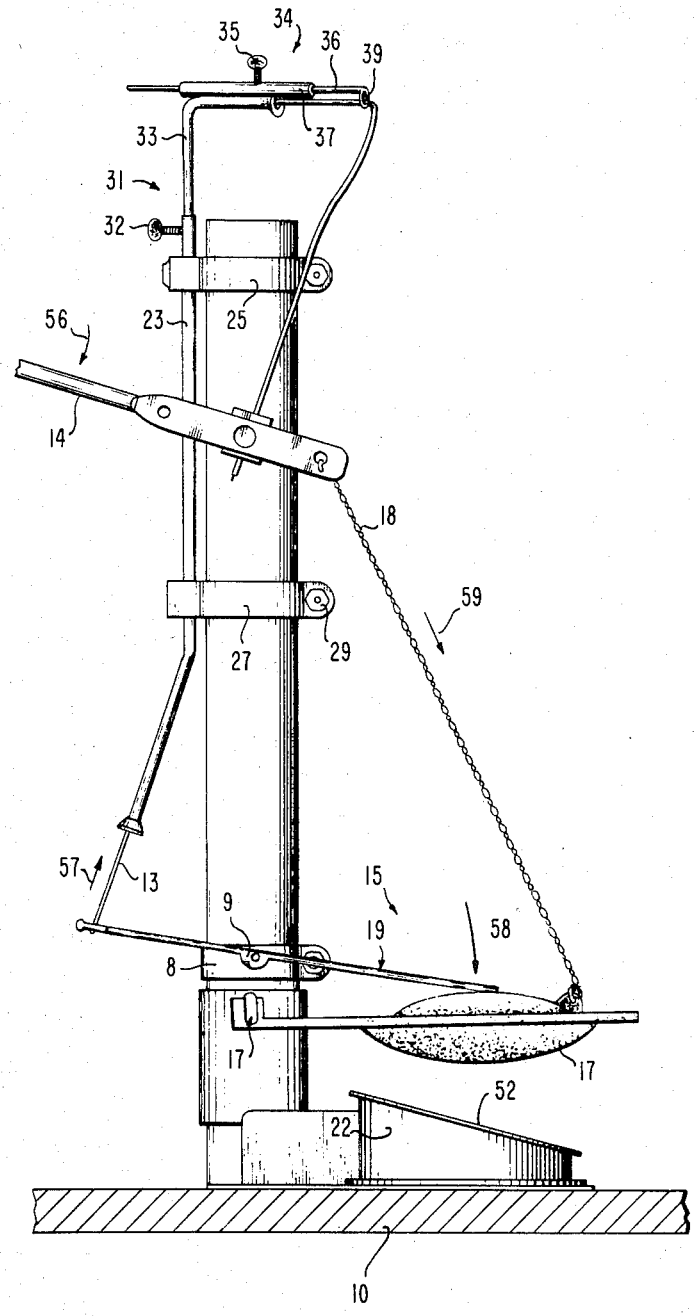
FIG. 3 is a side view, of the flush valve shown in FIG. 1, which shows the position of the valve during a pre-mature closing.

Any time after a flush has been initiated, it may be immediately and pre-maturely terminated by rotating flush handle 12 upward in the direction shown by arrow 3 in FIG. 1. This upward rotation, as shown in FIG. 3, rotates extension 14 in a downward direction, as shown by arrow 56. This, in turn, causes cable 13 to retract into the lower end of conduit 23, as shown by arrow 57. As a result abutting member 19 rotates downward, about pivot point 9, in the direction shown by arrow 58, and pushes (forces) flapper valve 17 towards base 22. Since downward rotation of extension 14 imparts slack to and moves chain 18 downward in the direction of arrow 59, flapper valve 17 is easily pushed against base 22 by the rotational movement of abutting member 19. Hence, as shown, as flush handle 12 is rotated upward to the full extend of its travel, flapper valve 17 becomes fully seated in base 22 and has completely terminated the most recently initiated flush.

Figure 4:
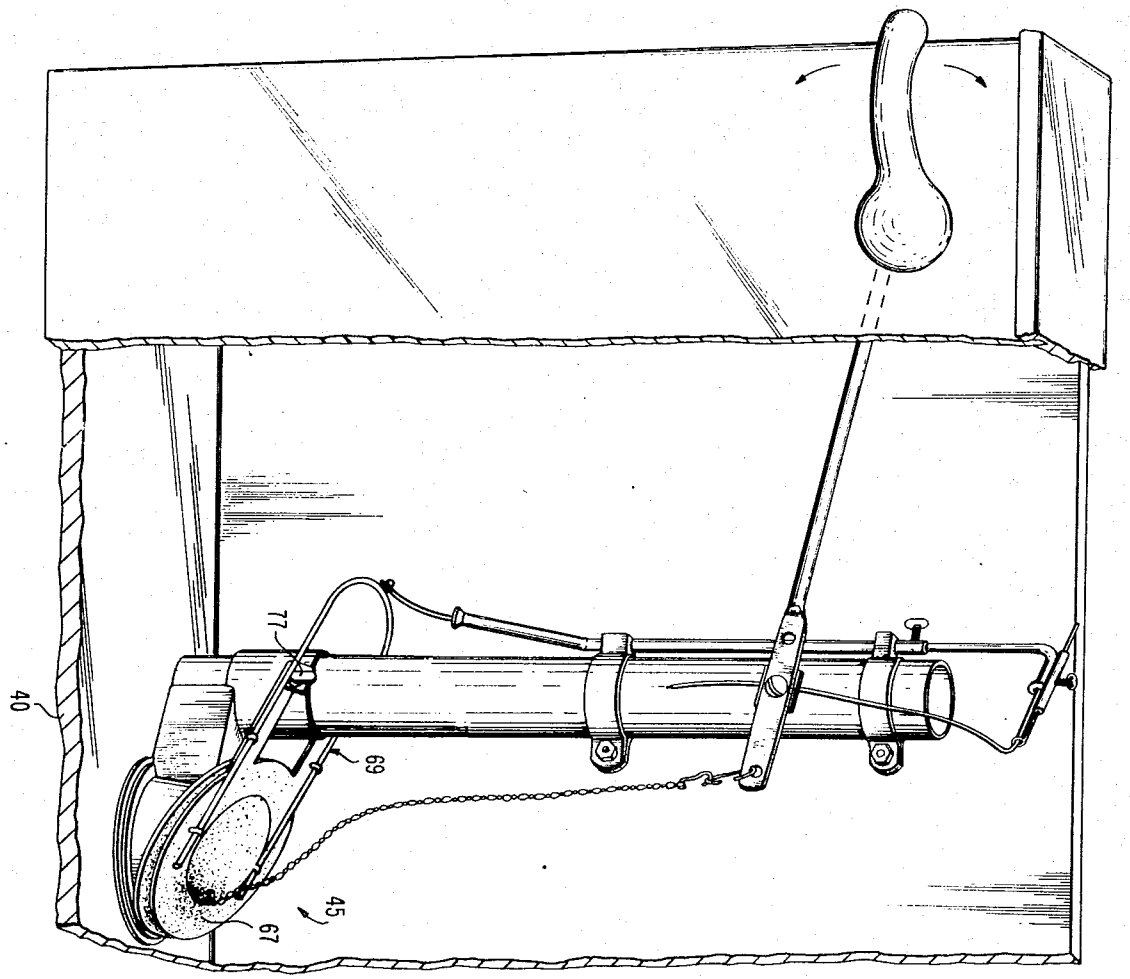
FIG. 4 is a partial cutaway view of toilet tank 40 showing an alternate embodiment of a flush valve which embodies the teachings of the present invention.

An alternate embodiment of a flush valve 45, constructed in accordance with the teachings of the present invention and mounted on tank 40, is shown in FIG. 4. Here, in contrast to that shown in FIGS. 1–3, flush valve 45 does not contain a separate abutting member but instead utilizes u-shaped section 69 which is secured to flapper valve 67 such that both rotate about pivot point 77.

Figure 5:
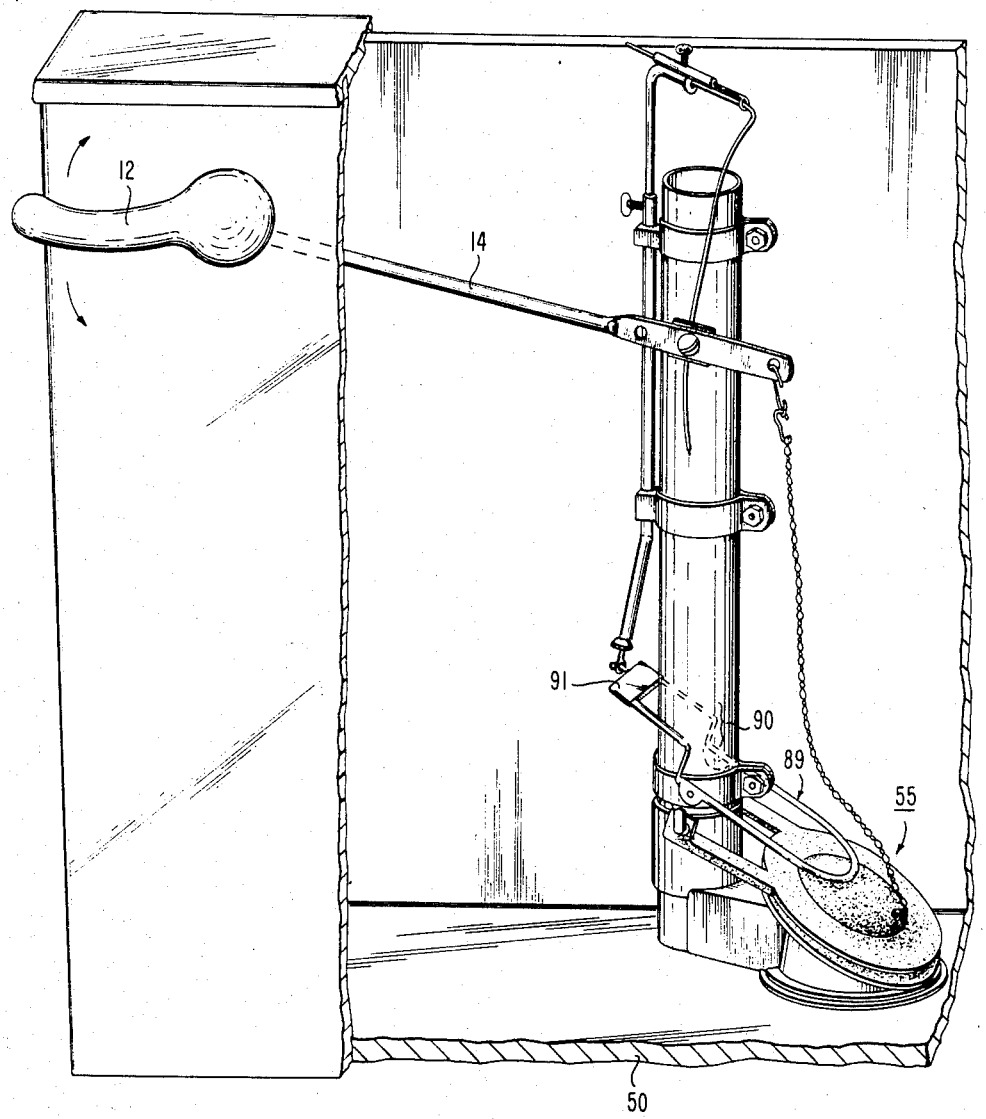
FIG. 5 is a partial cutaway view of toilet tank 50 showing another alternate embodiment of a flush valve which embodies the teachings of the present invention.

A further embodiment of a flush valve 55, constructed in accordance with the teachings of the present invention and mounted in tank 50, is shown in FIG. 5. Here, in contrast to that shown in FIGS. 1–3, abutting member 89 contains an offset 90 to elevate flat surface 91. This offsetted arrangement finds particular use in those situations where the rearwardly extending arms, or other components, of the flapper valve extend around the back of the overflow tube.

Clearly, it is readily apparent to those skilled in the art that a water-conserving flush valve, embodying the principles of the present invention, can utilize not only primarily a flapper valve but possibly a ball valve or any other type of valve that is seated into the base of an overflow tube. In addition, the pivot point associated with the abutting member is not limited to being situated on the overflow tube, but can be situated in front of (i.e. close to the flapper valve) or on the opposite side of the overflow tube.

Many varied arrangements can be made by those skilled in the art without departing from the spirit and scope of the invention.

I claim:

1. A flush valve for use in a toilet tank, said flush valve comprising:

an overflow tube, having a base abutting against the bottom of the toilet tank and connected to an end of said overflow tube and extending to one side of said tube;

a valve pivotting about the overflow tube and abuttingly seating against said base to assume a closed position or pivotting upward from said base to assume an open position thereby directing water from said tank in order to produce a flush, said valve having a control arm extending away from said overflow tube in a direction substantially opposite to that of said base;

a flush handle, mounted to an outside surface of said tank, having an extension arm situated within said tank and extending towards said overflow tube;

means situated about the overflow tube proximate to said valve and being responsive to rotational movement of the flush handle in a pre-determined direction for forcing the valve to a desired position, wherein the forcing means comprises:

a cable connected at one end thereof to an end of the extension arm located near the overflow tube and connected at the other end thereof to said control arm, and a conduit having two legs and mounted to said overflow tube and through which said cable is routed, the first leg extending laterally over a top end of said overflow tube and the second leg extending vertically downward and along said overflow tube, wherein each leg has a telescoping section for independently and appropriately adjusting the length and/or orientation of that section so that the cable assumes a substantially vertical orientation as it extends upward from the end of said extension arm and into the first leg of said conduit, whereby the flush valve can be readily installed in a wide variety of toilets without changing the flush handle existing therein.

2. The flush valve in claim 1 wherein the second leg comprises two concentrically aligned tubular members which telescopically slide against each other.

3. The flush valve in claim 2 wherein the second leg is situated along a side of the overflow tube oppositely situated from said base.

4. The flush valve in claim 3 wherein the first leg comprises a rod, having a loop at one end thereof and through which said cable is routed, which slides within a tubular section into which said set screw is threaded.

5. The flush valve in claim 4 wherein the first and second legs are oriented at approximately a right angle with respect to each other.

6. The flush valve in claim 5 wherein each telescoping section comprises means for locking the section to a pre-determined length and/or orientation.

7. The flush valve in claim 6 wherein the locking means is a set screw threaded into a portion of each telescoping section.

8. The flush valve in claim 7 wherein the valve further comprises either a flapper-type or ball-type valve.

9. A water conserving flush valve for use in a toilet tank, said flush valve comprising:

an overflow tube, having a base abutting against the bottom of the toilet tank and connected to an end of said overflow tube and extending to one side of said tube;

a flush handle, mounted to an outside surface of said tank, having an extension arm situated within said tank and extending towards said overflow tube;

a valve pivotting about the overflow tube and abuttingly seating against said base to assume a closed position or, in response to rotational movement of the flush handle in a first direction, pivotting upward from said base to assume an open position thereby directing water from said tank in order to produce a flush, said valve having a control arm extending away from said overflow tube in a direction substantially opposite to that of said base;

means situated about the overflow tube proximate to said valve and being responsive to rotational movement of the flush handle in a second direction for pre-maturely forcing the valve to the closed position at any time during the flush thereby limiting the amount of water consumed during the flush, wherein the forcing means comprises:

a cable connected at one end thereof to an end of the extension arm located near the overflow tube and connected at the other end thereof to said control arm, and a conduit having two legs and mounted to said overflow tube and through which said cable is routed, the first leg extending laterally over a top end of said overflow tube and the second leg extending vertically downward and along said overflow tube, wherein each leg has a telescoping section for independently and appropriately adjusting the length and/or orientation of that section so that the cable assumes a substantially vertical orientation as it extends upward from the end of said extension arm and into the first leg of said conduit, whereby the water conserving flush valve can be readily installed in a wide variety of toilets without changing the flush handle existing therein.

10. The flush valve in claim 9 wherein the second leg comprises two concentrically aligned tubular members which telescopically slide against each other.

11. The flush valve in claim 10 wherein the second leg is situated along a side of the overflow tube oppositely situated from said base.

12. The flush valve in claim 11 wherein each telescoping section comprises means for locking the section to a pre-determined length and/or orientaion.

13. The flush valve in claim 12 wherein the forcing means is approximately balanced about the overflow tube so as not to impose a rotational force on said flush handle whenever said flush handle is not rotated in said first or second direction.

14. The flush valve in claim 13 further comprised of appropriately sized weights mounted on said control arm in order to produce a balanced condition whenever said flush handle is not rotated in said first or said second direction.

15. The flush valve in claim 14 wherein the valve further comprises either a flapper-type or ball-type valve.

16. The flush handle in claim 15 wherein said forcing means is further comprised of a separate u-shaped member, to which said control arm is attached, which pivots about the overflow tube proximately above said flapper valve and abuts against the flapper valve and forces the flapper valve to a closed position whenever said flush handle is rotated in the second direction.

* * * * *